US008163991B2

(12) United States Patent
Rogitz

(10) Patent No.: US 8,163,991 B2
(45) Date of Patent: Apr. 24, 2012

(54) HEADPHONE METRONOME

(76) Inventor: Leo C. Rogitz, Phoenix, AZ (US)

( * ) Notice: Subject to any disclaimer, the term of this patent is extended or adjusted under 35 U.S.C. 154(b) by 307 days.

(21) Appl. No.: 12/576,879

(22) Filed: Oct. 9, 2009

(65) Prior Publication Data

US 2011/0083544 A1 Apr. 14, 2011

(51) Int. Cl.
*G10H 7/00* (2006.01)

(52) U.S. Cl. ..... 84/612

(58) Field of Classification Search ..... 84/612
See application file for complete search history.

(56) References Cited

U.S. PATENT DOCUMENTS

| | | | | |
|---|---|---|---|---|
| 5,751,825 | A | 5/1998 | Myers et al. | |
| 2004/0182228 | A1* | 9/2004 | Brett | 84/612 |
| 2007/0199431 | A1* | 8/2007 | Kashioka | 84/612 |
| 2008/0282872 | A1* | 11/2008 | Ma et al. | 84/627 |

* cited by examiner

*Primary Examiner* — Jianchun Qin
(74) *Attorney, Agent, or Firm* — John L. Rogitz

(57) ABSTRACT

A user can select to play a metronome of the user's voice or a default which is played on headphones at a user-established tempo.

11 Claims, 1 Drawing Sheet

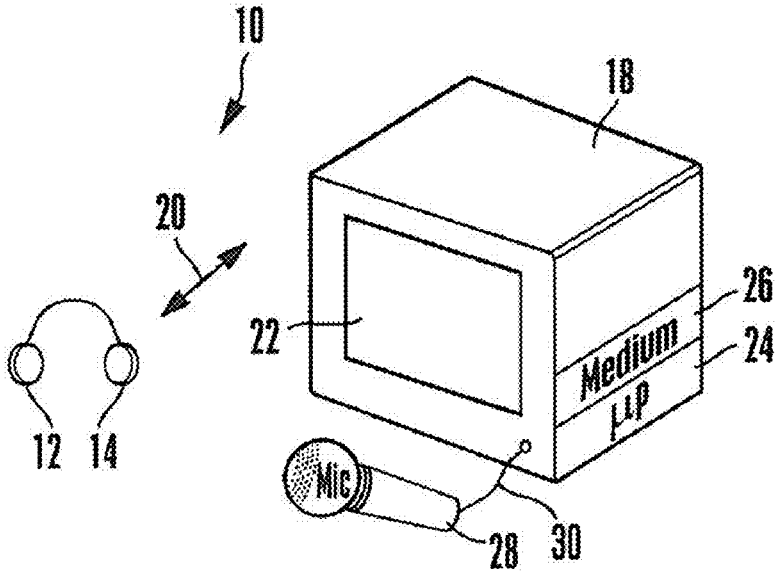
Figure 1
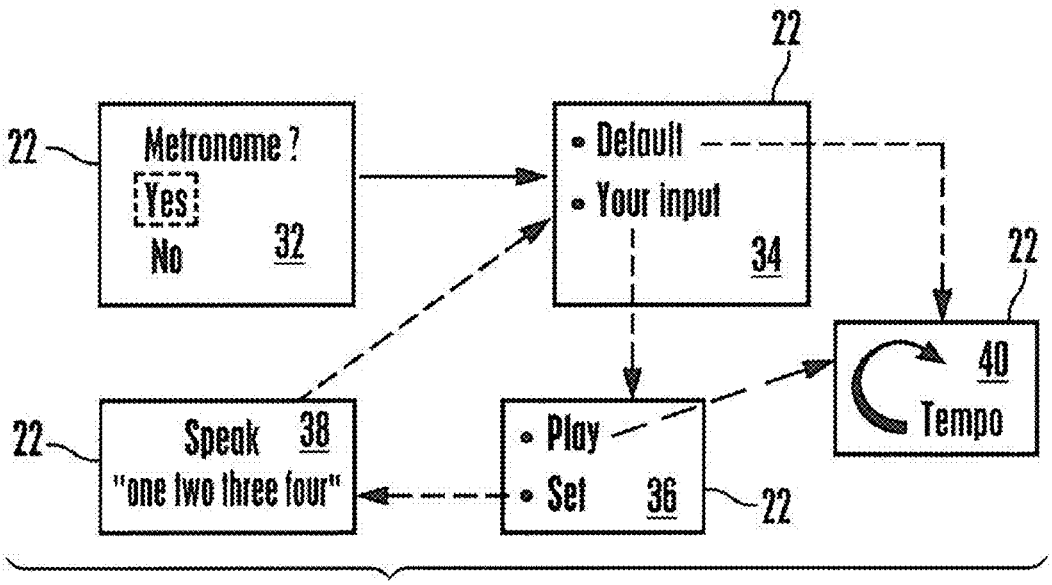
Figure 2 touch screen shots
Figure 3 logic
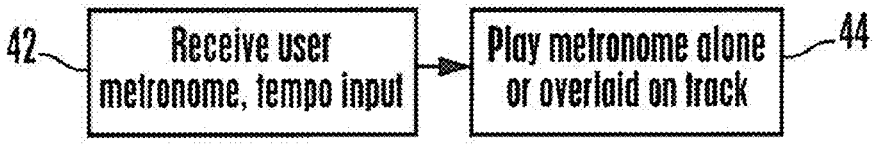

HEADPHONE METRONOME

FIELD OF THE INVENTION

The present invention relates generally to headphone metronomes.

BACKGROUND OF THE INVENTION

Many musicians could benefit, as understood herein, from listening to a rhythm-keeping sound when playing instrument or singing.

SUMMARY OF THE INVENTION

A headphone metronome system includes a processor, a computer readable storage medium accessible by the processor and storing signals representing at least one metronome in a data structure, and at least one speaker receiving signals under control of the processor for converting the signals into an audible display. The processor receives user input representing a desired tempo and in response causes the speaker to play sound a representation of which is stored in the data structure at the desired tempo.

In example embodiments the processor receives input of a personalized metronome from a microphone into which a user can speak. The metronome may be overlaid onto an audio track or played on the speaker without overlaying the metronome on an audio track.

In some implementations the processor presents a metronome select user interface (UI) on the display from which a user may select whether to turn the metronome on. The processor can also present a type selection UI on the display allowing the user to select a default metronome sounds and to select a personalized metronome. In response to selecting the personalized metronome, the processor may present a personalization UI on the display from which the user can select to play a personalized metronome that had been previously input by the user speaking into a microphone or to set a personalized metronome. On the other hand, in response to a user selecting to play the metronome the processor can present on the display a tempo UI to establish the tempo at which the metronome is played. The tempo UI can include an arcuate symbol along which a user may move a finger to increase and decrease the tempo.

In another aspect, a method includes, at a processor, receiving metronome type and tempo selections generated by a user. The method includes causing the processor to send signals to ear pieces wearable by a human to in turn cause the metronome type to be audibly displayed on the ear pieces at the tempo.

The details of the present invention, both as to its structure and operation, can best be understood in reference to the accompanying drawings, in which like reference numerals refer to like parts, and in which:

BRIEF DESCRIPTION OF THE DRAWINGS

FIG. 1 is a schematic view of an example headphone metronome system;

FIG. 2 is a series of example screen shots for implementing a headphone metronome playing session; and FIG. 3 is a flow chart of example logic.

DETAILED DESCRIPTION OF THE PREFERRED EMBODIMENT

Referring initially to FIG. 1, a headphone metronome system includes a headphone with left and right ear pieces 12, 14 that include small speakers. The ear pieces 12, 14 may fit inside the human ear or may be larger to fit over the ears, in which case they may include a padded cushion.

The ear pieces 12, 14 typically are connected by a connector 16, which may be a semi-rigid head rest fitted to rest securely on a human head or, as shown, a flaccid wire-like structure. In any case, the speakers of the ear pieces 12, 14 receive signals from a player 18 over a wired or wireless link 20, with the speakers converting the signals to audible sound that the wearer of the ear pieces 12, 14 can hear.

The example player 18 shown in FIG. 1 may include a housing holding a video display 22 such as a touch-screen display. Information may be presented on the display 22 under control of a processor 24 accessing a tangible computer readable storage medium 26 such as disk-based or solid state storage. The processor 24 can generate the user interfaces shown below in FIG. 2 and can execute the logic of FIG. 3 which may be embodied as computer code stored on the medium 26 along with, e.g., music, video, etc.

In the example shown the processor 24 can receive voice input from a microphone 28, which converts user voice signals into electrical signals for input to the processor 24 and/or storage on the medium 26 in accordance with description below. While the microphone 28 is shown to be external to the player housing and connected thereto by a cord 30, it is to be understood that the microphone 28 may be contained within the housing.

The processor 22 may cause a metronome select user interface (UI) 32 to be presented on the display 22, giving the user the option to select (by, e.g., touching the desired selection) whether to turn the metronome feature on or off. If the user selects to turn the metronome feature on, a type selection UI 34 may be presented on the display 22 allowing the user to select from one or more default metronome sounds, such as clicks, bangs, etc. or to select a personalized input.

If the personalized input is selected, a personalization UI 36 may be presented on the display 22 in which the user can select to play a personalized metronome that had been previously input by the user speaking into the microphone 28, or to set a personalized metronome. When the user wishes to set a new personalized metronome, a UI 38 may be presented on the display 22 instructing the user to, e.g., speak "one, two, three, four" into the microphone 28. When the user sets the personalized metronome it is recorded by the processor 24 on the medium 26. After setting a new personalized metronome, the type selection UI 34 may be presented again on the display 22.

When "default" is selected from the type selection UI 34 or when "play" is selected from the personalization UI 36, a tempo UI 40 may be presented to permit the user to establish the tempo at which the selected metronome is played. In the embodiment shown, the tempo UI 40 includes an arcuate symbol whose thickness decreases toward the arrowhead shown at the end of the arc, indicating that the tempo is decreased if the user traces his or her finger against the display 22 along the arc in the direction of the arrow and increased if the user traces his or her finger in the opposite direction. In any case, the metronome may be played at a default tempo or last-selected tempo immediately upon selecting "play", with the user being able to change the tempo by tracing a finger against the display in the desired direction on the arc.

By "tempo" is meant a regular temporal interval between temporally successive metronome audible elements. For example, if a default metronome of clicks has been selected, a faster tempo means more clicks per time interval are played then a slower tempo, with the period between clicks being constant and regular for any particular tempo. The metronome plays until de-selected.

Or, if a personalized tempo is selected such as a user's spoken "one, two, three, four" the period between each played word is constant for a particular tempo. A slow tempo might result in 1.0 seconds, for example, elapsing between playing the word "one" and playing the word "two", with the same period elapsing between playing the word "two" and playing the word "three", etc. After the word "four" is played the period defined by the tempo elapses and then the word "one" is played again, with the process continuing in this loop until the metronome is turned off by the user. A faster tempo might result in the period between playing the user's words to be shorter, e.g., on the order of 0.2 seconds. It will readily be appreciated that an infinite number of tempos may be set using the UI 40 shown in FIG. 2.

FIG. 3 shows that at state 42 the processor 24 receives the metronome type and tempo selections described above. At block 44 the processor sends signals to the ear pieces 12, 14 causing the selected metronome to be audibly displayed on the ear pieces at the selected tempo, which the user can change real time by appropriately manipulating the UI 40. If desired, the metronome may be played by itself or, at the user's option, overlaid onto an audio track, e.g., a particular piece of music.

While the particular HEADPHONE METRONOME is herein shown and described in detail, it is to be understood that the subject matter which is encompassed by the present invention is limited only by the claims. For example, while a touch screen is shown for inputting metronome selections and tempo selection, in other implementations analog-type inputs may be used, e.g., switches to switch the metronome on and off and thumbwheels operating variable resistors to increase/decrease playback speed and, thus, establish a desired tempo of the metronome.

What is claimed is:

1. A headphone metronome system comprising:

a processor;

a computer readable storage medium accessible by the processor and storing signals representing at least one metronome in a data structure; and at least one speaker receiving signals under control of the processor for converting the signals into an audible display; wherein the processor receives user input representing a desired tempo and in response causes the speaker to play sound a representation of which is stored in the data structure at the desired tempo, wherein the processor presents a type selection user interface (UI) on the display allowing the user to select a default metronome sounds and to select a personalized metronome, wherein in response to a user selecting to play the metronome the processor presents on the display a tempo UI to establish the tempo at which the metronome is played, wherein the tempo UI includes an arcuate symbol along which a user can move a finger to increase and decrease the tempo.

2. The system of claim 1, wherein the processor receives input of a personalized metronome from a microphone into which a user can speak.

3. The system of claim 1, wherein the metronome is overlaid onto an audio track.

4. The system of claim 1, wherein the metronome is played on the speaker without overlaying the metronome on an audio track.

5. The system of claim 1, wherein the processor presents a metronome select UI on the display from which a user can select whether to turn the metronome on.

6. The system of claim 1 wherein in response to selecting the personalized metronome, the processor presents a personalization UI on the display from which the user can select to play a personalized metronome that had been previously input by the user speaking into a microphone or to set a personalized metronome.

7. Method comprising:

at a processor, receiving metronome type and tempo selections generated by a user;

causing the processor to send signals to ear pieces wearable by a human to in turn cause the metronome type to be audibly displayed on the ear pieces at the tempo, wherein in response to a user selecting to play a metronome the processor presents on the display a tempo user interface (UI) to establish the tempo at which the metronome is played, wherein the tempo UI includes an arcuate symbol along which a user can move a finger to increase and decrease the tempo.

8. The method of claim 7, wherein the user can change the tempo in real time by appropriately manipulating a tempo UI.

9. The method of claim 7, wherein the metronome type is played by itself.

10. The method of claim 7, wherein the metronome type is overlaid onto an audio track.

11. The method of claim 7, wherein the metronome type is user-spoken numerals repeated in a loop.

* * * * *